US007654835B1

(12) United States Patent
Chiang

(10) Patent No.: US 7,654,835 B1
(45) Date of Patent: Feb. 2, 2010

(54) ELECTRICAL CONNECTOR

(75) Inventor: Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,692

(22) Filed: Sep. 23, 2008

(51) Int. Cl.
*H01R 13/44* (2006.01)

(52) U.S. Cl. ..... 439/137; 439/142; 439/521; 439/607.53

(58) Field of Classification Search ..... 439/135–142, 439/521, 607.01, 607.53, 607.54
See application file for complete search history.

(56) References Cited

U.S. PATENT DOCUMENTS 4,530,557 A * 7/1985 Katsube et al. ..... 439/325
5,501,607 A * 3/1996 Yoshioka et al. ..... 439/142
5,842,886 A * 12/1998 Illg et al. ..... 439/607
6,375,480 B1 * 4/2002 Chen et al. ..... 439/142
7,086,880 B2 * 8/2006 Uchida ..... 439/141
7,097,475 B2 * 8/2006 Cheng ..... 439/138
7,140,891 B1 * 11/2006 Huang et al. ..... 439/137
7,258,574 B2 * 8/2007 Barringer et al. ..... 439/607
7,381,068 B1 * 6/2008 Lin et al. ..... 439/136
2004/0229484 A1 * 11/2004 Uchida ..... 439/137

* cited by examiner

*Primary Examiner*—James Harvey
(74) *Attorney, Agent, or Firm*—Rosenberg, Klein & Lee

(57) ABSTRACT

An electrical connector includes a housing having a plurality of terminals received within and a shell encircling the housing therein. The shell has a mating opening at one end thereof. A dustproof cover is assembled in the shell and positioned between the mating opening and the housing to perform anti-dust function. The dustproof cover has an insulator and a metal sheet combined with the insulator to strengthen the structure of the dustproof cover. The dustproof cover is of enough intensity and is not prone to deformation in use and therefore offers fully anti-dust function for the electrical connector.

11 Claims, 4 Drawing Sheets

ELECTRICAL CONNECTOR

BACKGROUND OF THE INVENTION

1. Field of the Invention

The present invention relates to an electrical connector, and more particularly to a dustproof electrical connector.

2. The Related Art

Nowadays, electrical connectors are widely used in electronic products with the development of the technology of the electrons. In order to protect terminals of the electrical connectors from being dirtied by dust, the electrical connectors have dustproof function to come with the tendency. A known dustproof electrical connector includes a housing, a plurality of terminals received in the housing, a dustproof cover and a shell for encircling the housing and the dustproof cover therein. The dustproof cover is installed in front of the housing to perform the dustproof function.

Considering the miniaturization trend of the electronic products, the electrical connectors should be designed smaller to follow the trend. Correspondingly, the dustproof covers of the dustproof electrical connectors become thinner as well. However, the above-mentioned dustproof cover is made of insulating material (e.g. plastic). The thinner the dustproof cover is, the weaker the structural strength thereof is. Therefore, the dustproof cover is prone to plastic deformation and failing in the dustproof efficacy.

SUMMARY OF THE INVENTION

It is an object of the present invention to provide an electrical connector having an improved dustproof cover. The electrical connector includes a housing having a plurality of terminals received therein and a shell encircling the housing therein. The shell has a mating opening at one end thereof. A dustproof cover is assembled in the shell and positioned between the mating opening and the housing to perform dustproof function. The dustproof cover has an insulator and a metal sheet combined with the insulator to strengthen the structure of the dustproof cover.

As described above, by disposing the metal sheet combined with the insulator to strengthen the structure of the dustproof cover, the dustproof cover can provide enough intensity to avoid deformation and losing the dustproof capability effectively.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
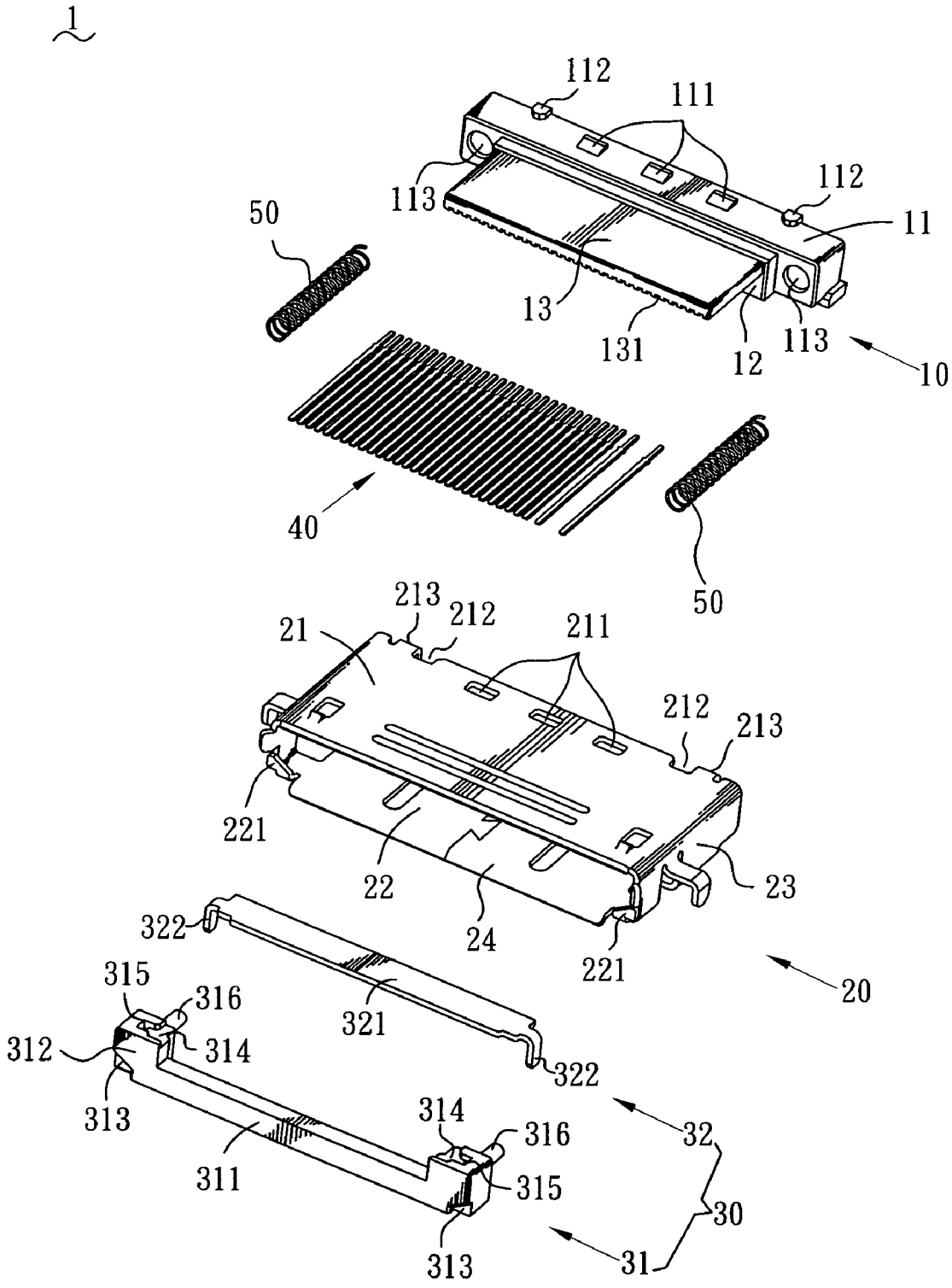
FIG. 1 is an exploded view of an electrical connector in accordance with the present invention.

With reference to FIG. 1, an electrical connector 1 according to the invention is shown. The electrical connector 1 includes a housing 10, a shell 20, a dustproof cover 30, a plurality of terminals 40 and a pair of springs 50.

Figure 2:
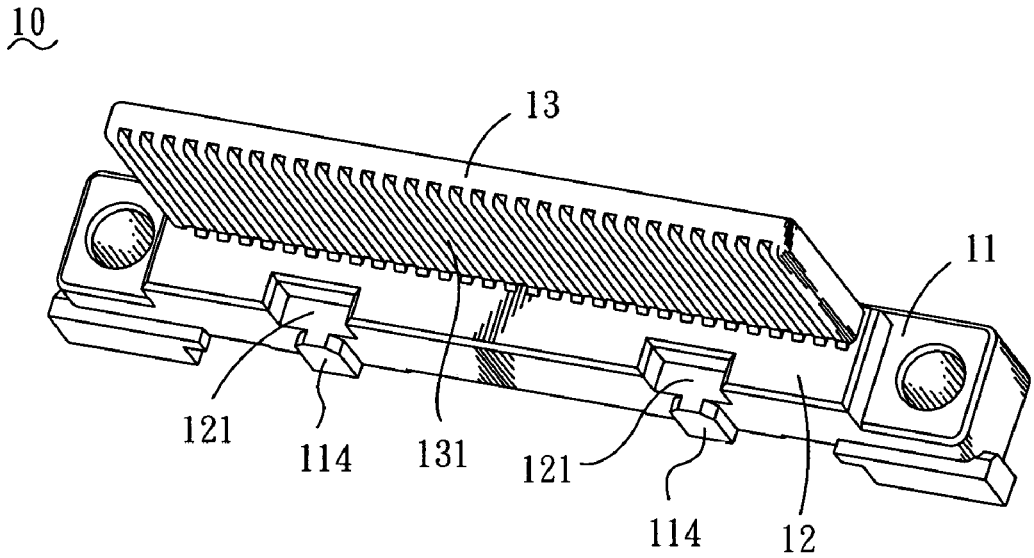
FIG. 2 is a perspective view of a housing of the electrical connector.
Figure 3:
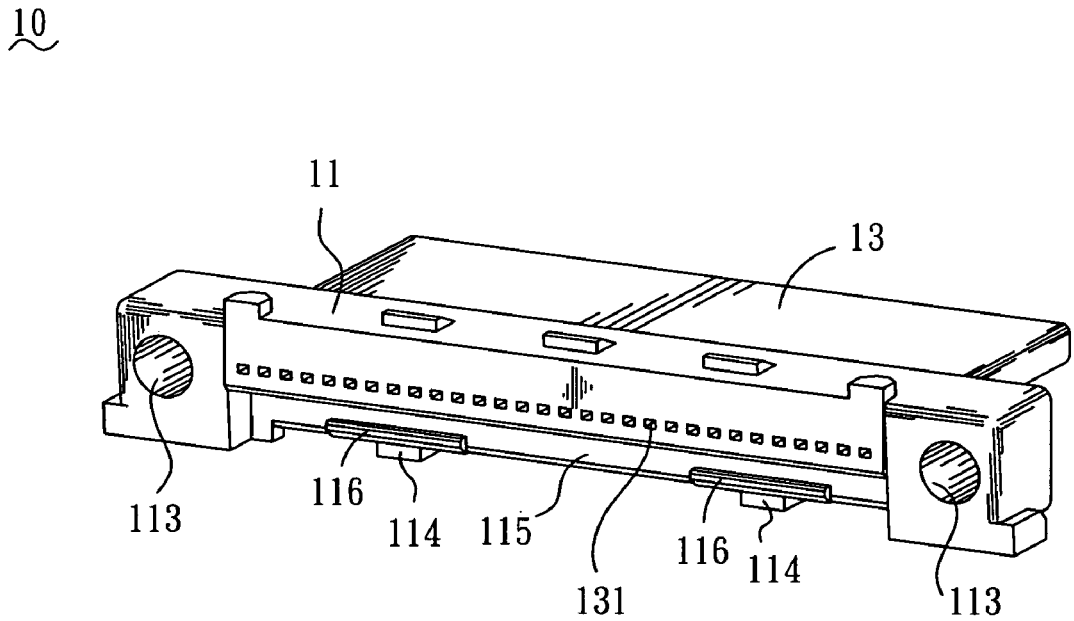
FIG. 3 is another perspective view of the housing of the electrical connector.

Please refer to FIGS. 1 to 3. The housing 10 has a substantially rectangular base portion 11. A top surface of the base portion 11 has plural substantially wedge-shaped lumps 111 aligned in a middle portion thereof and two protruding lumps 112 disposed at a rear end thereof. The base portion 11 has a raised platform 12 projecting from a front surface thereof and two through-holes 113 adjacent to two opposite sides of the base portion 11 respectively. A tongue portion 13 extends forward from an upper portion of the raised platform 12 and defines a row of terminal grooves 131 at a bottom thereof. The terminal grooves 131 further penetrate through the base portion 11.

The raised platform 12 defines two retaining recesses 121 beneath the tongue portion 13. The base portion 11 has a pair of retaining lumps 114 projecting out of a bottom surface thereof and corresponding to the retaining recesses 121. At a rear surface of the base portion 11, a resisting channel 115 is transversely formed below the terminal grooves 131 and two projecting strips 116 are arranged in the resisting channel 115.

Figure 4:
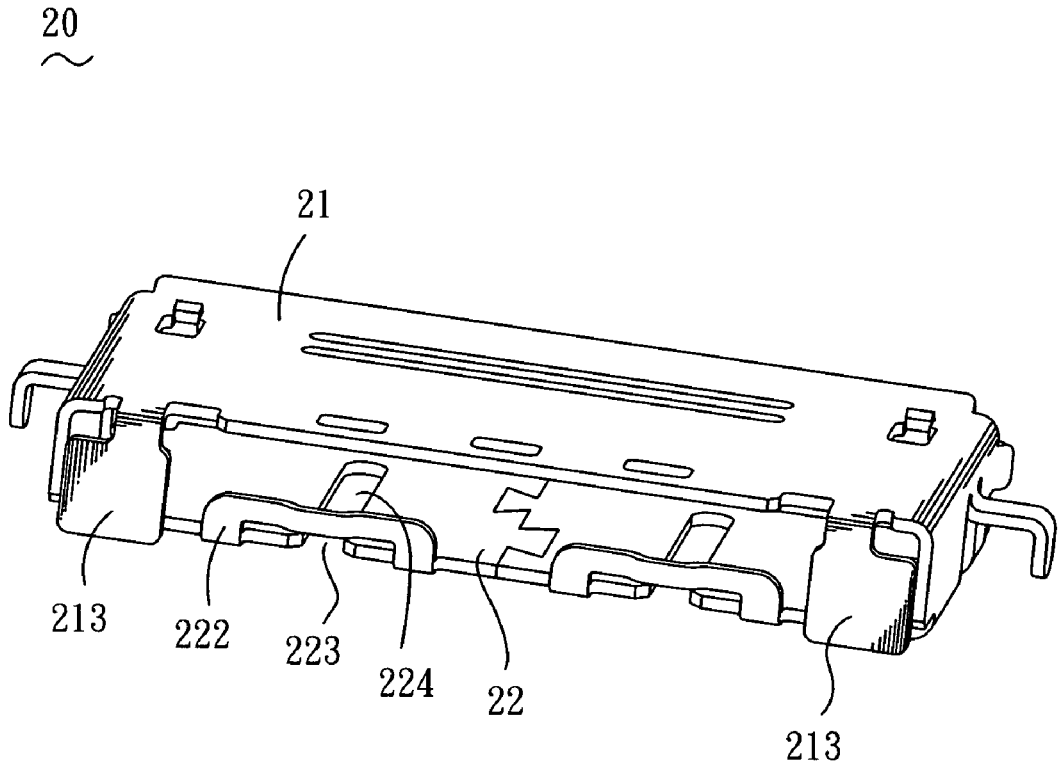
FIG. 4 is a perspective view of a shell of the electrical connector.

Please refer to FIG. 1 and FIG. 4 together, the shell 20 has a top plate 21, a bottom plate 22 parallel with the top plate 21, and two side plates 23 connecting the top plate 21 with the bottom plate 22. The top plate 21, the bottom plate 22 and the side plates 23 collectively define a receiving room (not labeled) for containing the housing 10, the dustproof cover 30 and the pair of springs 50 therein. A mating opening 24 is formed at a front end of the shell 20 and communicated with the receiving room. The top plate 21 defines plural locating holes 211 at a rear portion thereof for fixing the wedge-shaped lumps 111. Two openings 212 are disposed at a rear edge of the top plate 21 and adjacent to the side plates 23 respectively. Each opening 212 has a stopper 213 extending downward therefrom. The bottom plate 22 defines a pair of locking tabs 221 curling upwardly from a front edge thereof and abutting against the side plates 23. At a rear edge of the bottom plate 22, two resisting pieces 222 are arranged between the stoppers 213 and each of the resisting pieces 222 transversely defines a seam 223 thereon. The bottom plate 23 further longitudinally defines two guiding slots 224 communicated with the corresponding seams 223.

Figure 5:
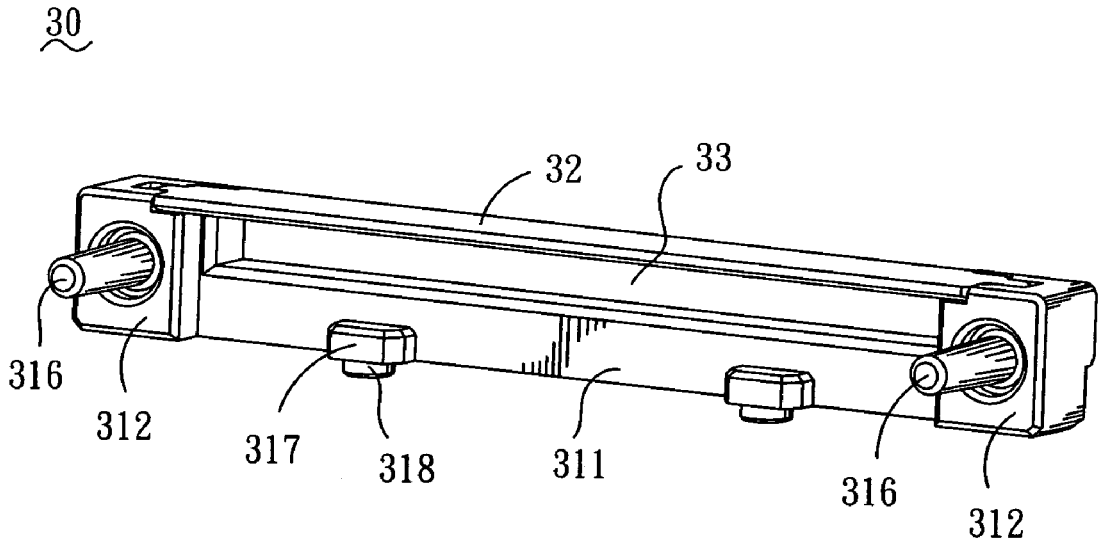
FIG. 5 is a perspective view showing a dustproof cover of the electrical connector.

Referring to FIG. 1 and FIG. 5, the dustproof cover 30 includes an insulator 31 and a metal sheet 32 combined with the insulator 31 to form an insertion mouth 33 therebetween. The insulator 31 has a base bar 311 and two substantially square raised blocks 312 perpendicularly extending upwardly from two ends of the base bar 311. Two corners of the insulator 31 opposite to each other respectively define a notch 313 positioned at a front surface of each raised block 312. Each of the raised blocks 312 has an engaging trough 314 at a top surface thereof. A bottom side of the engaging trough 314 extends downward to form an inserting cavity 315. Two locating rods 316 are protruded from a rear portion of each raised block 312 respectively. The base bar 311 has two projections 317 at a lower portion of a rear surface thereof. Each of the projections 317 has a sliding lump 318 adhered to a bottom thereof. The sliding lump 318 is smaller than the projection 317.

The metal sheet 32 has a base plate 321, and the thickness of the base plate 321 can be changed according to the depth of the engaging trough 314. Middle portions of two short sides of the base plate 321 extend downward to form an inserting portion 322 respectively. The metal sheet 32 is assembled to the insulator 31 in such a manner that the inserting portions 322 are inserted into the inserting cavities 315 and two ends of the base plate 321 are sunk into the engaging troughs 314 to keep the base plate 321 at the same level with top surfaces of the raised blocks 312.

Figure 6:
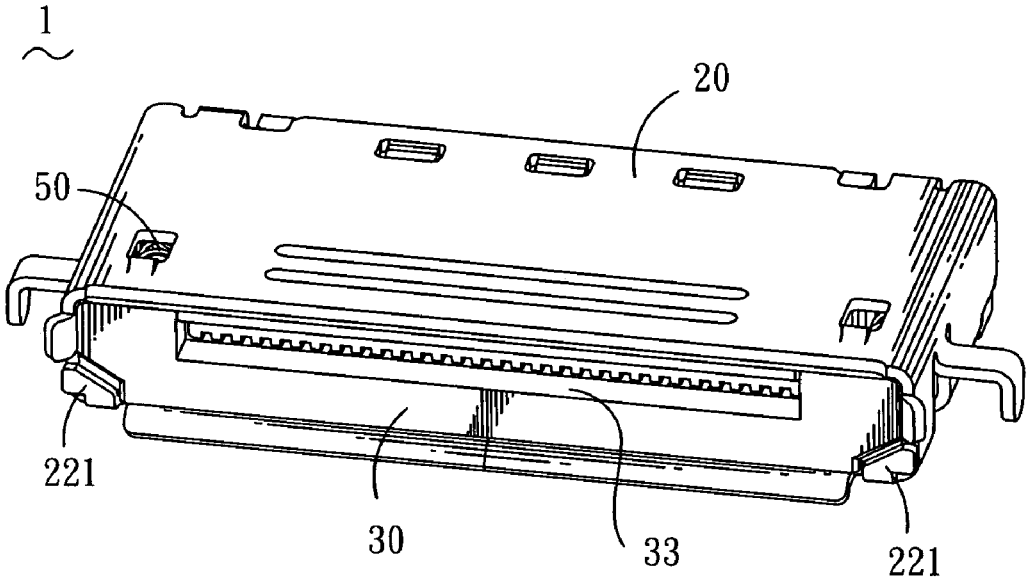
FIG. 6 is a perspective view of the electrical connector shown in FIG. 1.
Figure 7:
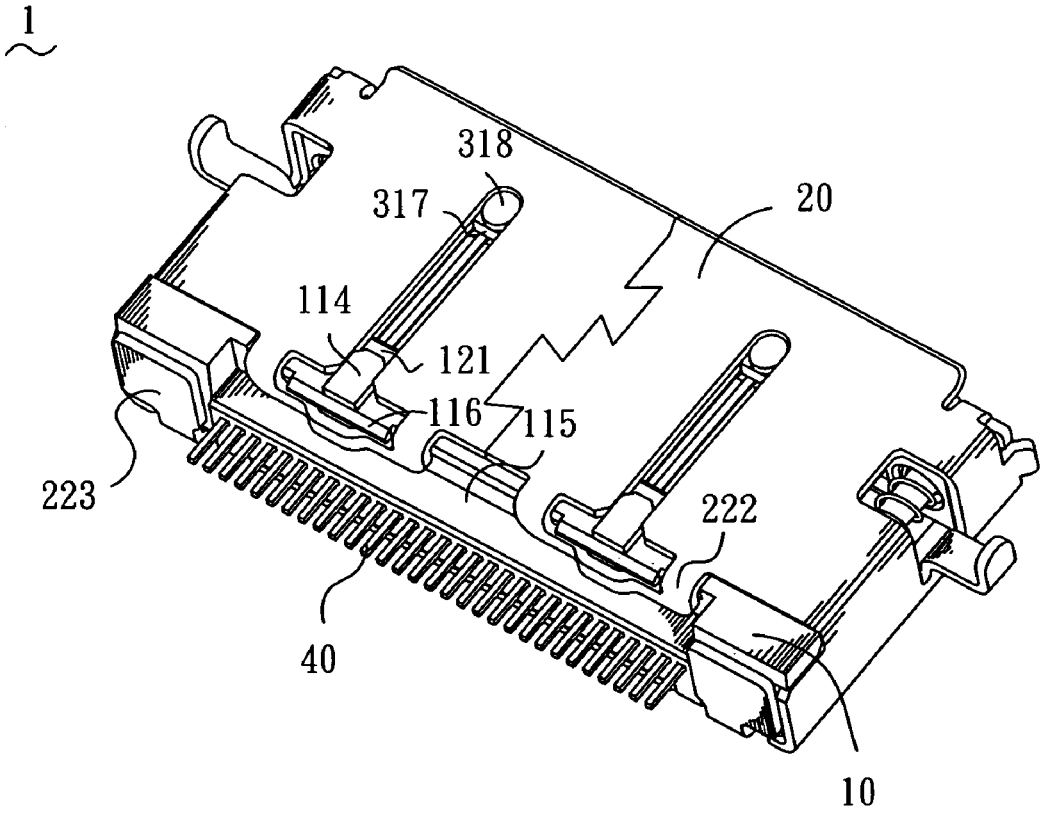
FIG. 7 is another angle perspective view of the electrical connector shown in FIG. 6.

Please refer to FIGS. 6 and 7. In assembly, the plurality of terminals 40 are correspondingly received in the terminal grooves 131. The housing 10 is received in the shell 20. In this case, the wedge-shaped lumps 111 are fixed into the locating holes 211 while the protruding lumps 112 are located at the openings 212, the resisting pieces 222 are buckled in the resisting channel 115, the retaining lumps 114 are respectively positioned at open ends of the guiding slots 224 and the projecting strips 116 are jammed into the corresponding seams 223. One end of each spring 50 encircles the locating rod 316 of the dustproof cover 30 and the other end passes through the through-hole 113 of the housing 10 and presses against the stopper 213 of the shell 20. The dustproof cover 30 is assembled in the shell 20 with a front end of the tongue portion 13 of the housing 10 adjacent to the insertion mouth 33 and the locking tabs 221 engaged with the corresponding notches 313. In this case, the projections 317 are placed on the guiding slots 224 and the sliding lumps 318 are disposed at closed ends of the guiding slots 224.

When a complementary connector (not shown) is plugged in the electrical connector 1, the complementary connector pushes the dustproof cover 30 rearward, then the springs 50 are compressed and the sliding lumps 318 move rearward along the guiding slots 224 until the projections 317 received in the retaining recesses 121 and the sliding lumps 318 stopped by the retaining lumps 114. Thus, the complementary connector is mated with the electrical connector 1, and the terminals 20 pass through the insertion mouth 33 to electrically connect with the complementary connector. When the complementary connector is draw out of the electrical connector 1, the dustproof cover 30 can return to original position to exert the dustproof function because of the elastic potential energy of the springs 50. The locking tabs 221 are engaged in the notches 313 to prevent the dustproof cover 30 from springing out of the shell 20. Because the dustproof cover 30 has the metal sheet 32 combined with the insulator 31, the structural strength of the dustproof cover 30 is improved, so that the dustproof cover 30 is not easy deformation and to lost the dustproof capability when sliding back and forth.

As the above description, by disposing the metal sheet 32 combined with the insulator 31 to strengthen the structure of the dustproof cover 30, the dustproof cover 30 can provide enough intensity to avoid deformation and losing the dustproof capability effectively even though the insulator 31 becomes smaller and thinner. Moreover, the total size and height of the dustproof cover 30 is not increased.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

a housing receiving a plurality of terminals therein;

a shell encircling the housing therein and having a mating opening at one end thereof;

a dustproof cover assembled in the shell and positioned between the mating opening and the housing, the dustproof cover having an insulator and a metal sheet combined with the insulator; and an elastic element, one end of the elastic element being against the dustproof cover, another end of the elastic element passes through the housing and is against the shell.

2. The electrical connector as claimed in claim 1, wherein the insulator has a base bar and two raised blocks substantially perpendicularly extending upwardly from two ends of the base bar, two ends of the metal sheet are respectively fixed to the two raised blocks, an insertion mouth is formed between the insulator and the metal sheet.

3. The electrical connector as claimed in claim 2, wherein the housing has a tongue portion with a free end adjacent to the insertion mouth.

4. The electrical connector as claimed in claim 2, wherein each of the raised blocks defines an engaging trough on a top thereof, the metal sheet has a base plate with two ends disposed onto the corresponding engaging troughs.

5. The electrical connector as claimed in claim 4, wherein two ends of the base plate of the metal sheet extend downwardly to form two inserting portions, each of the engaging troughs further defines an inserting cavity for engaging with the corresponding inserting portion.

6. The electrical connector as claimed in claim 2, wherein the metal sheet has a base plate, two ends of the base plate of the metal sheet extend downwardly to form two inserting portions, a top of each of the raised blocks defines an inserting cavity for engaging with the corresponding inserting portion.

7. The electrical connector as claimed in claim 6, wherein the inserting portion is narrower than the base plate.

8. The electrical connector as claimed in claim 1, wherein two corners of the insulator opposite to each other each have a notch formed therein, each of two sides of a bottom plate of the shell being respectively bent towards the mating opening to form a pair of locking tabs for being respectively engaged with the pair of notches.

9. The electrical connector as claimed in claim 1, wherein the shell defines at least one guiding slot at a bottom plate thereof, the dustproof cover has at least one sliding lump projecting out of a bottom thereof and movably buckled into the guiding slot.

10. An electrical connector, comprising:

a housing receiving a plurality of terminals therein;

a shell encircling the housing therein and having a mating opening at one end thereof; and a dustproof cover assembled in the shell and positioned between the mating opening and the housing, the dustproof cover having an insulator and a metal sheet combined with the insulator, the insulator having a base bar and two raised blocks substantially perpendicularly extending upwardly from two ends of the base bar, two ends of the metal sheet being respectively fixed to the two raised blocks, an insertion mouth being formed between the insulator and the metal sheet.

11. An electrical connector, comprising:

a housing receiving a plurality of terminals therein;

a shell encircling the housing therein and having a mating opening at one end thereof, the shell defines at least one guiding slot at a bottom plate thereof; and a dustproof cover assembled in the shell and positioned between the mating opening and the housing, the dustproof cover having an insulator and a metal sheet combined with the insulator, the dustproof cover having at least one sliding lump projecting out of a bottom thereof and movably buckled into the guiding slot.

* * * * *